United States Patent [19]

Roy et al.

[11] Patent Number: 4,957,253

[45] Date of Patent: Sep. 18, 1990

[54] BABY BOTTLE HOLDER

[76] Inventors: William C. Roy; Judith A. Roy, both of 1548 D Apache Dr., Chula Vista, Calif. 92010; Russell C. Edmisson, 329 Poinsettia Ave., Coronado del Mar, Calif. 92625

[21] Appl. No.: 420,590

[22] Filed: Oct. 12, 1989

Related U.S. Application Data

[63] Continuation-in-part of Ser. No. 209,308, Jun. 21, 1988, abandoned, and a continuation-in-part of Ser. No. 280,250, Dec. 5, 1988, abandoned.

[51] Int. Cl.[5] ..... A47D 15/00

[52] U.S. Cl. ..... 248/104

[58] Field of Search ..... 248/102, 103, 104, 105, 248/106, 107, 324, 327

[56] References Cited

U.S. PATENT DOCUMENTS

| | | | |
|---|---|---|---|
| 753,683 | 3/1904 | Dixon | 248/103 |
| 1,220,266 | 3/1917 | Ott | 248/103 |
| 1,688,765 | 10/1928 | Veras | 248/103 |
| 1,753,875 | 4/1930 | Baumann | 248/103 |
| 1,900,691 | 3/1933 | Carlson | 248/102 |
| 2,448,189 | 8/1948 | Mott | 248/104 |
| 2,470,694 | 5/1949 | Foo | 248/106 |
| 2,490,158 | 12/1949 | Reynolds | 248/103 |
| 2,500,846 | 3/1950 | McFarland | 248/102 |
| 2,638,296 | 5/1953 | Battle | 248/105 |
| 2,907,539 | 10/1959 | Vardan | 248/104 |
| 2,909,345 | 10/1959 | Matsuoka | 248/106 |
| 3,016,221 | 1/1962 | Underwood | 248/102 |
| 3,144,230 | 8/1964 | Brooks | 248/102 |
| 3,197,099 | 7/1965 | Doba | 248/102 |
| 3,222,020 | 12/1965 | Rea | 248/106 |
| 3,289,986 | 12/1966 | Martin | 248/103 |
| 3,627,244 | 12/1971 | Nicholas | 248/103 |
| 3,977,638 | 8/1976 | Woodard | 248/102 |
| 4,498,613 | 1/1985 | Donahue | 248/102 |
| 4,537,341 | 8/1985 | Kelly | 248/104 |

*Primary Examiner*—Ramon O. Ramirez
*Assistant Examiner*—Robert A. Olson
*Attorney, Agent, or Firm*—Henry J. A. Charmasson

[57] ABSTRACT

A nursing bottle support for freeing the hands of a person carrying an infant while feeding the infant from the bottle comprises a bendable, non-resilient hook which wraps around the person's neck with an expandable shank lying against the person's chest. A clasp made of an open-ring of elastomeric material is rotatably mounted at the end of the shank, and can be positioned in a variety of orientations to direct the bottle toward the mouth of the feeding infant.

7 Claims, 1 Drawing Sheet

BABY BOTTLE HOLDER

PRIOR APPLICATIONS

This application is a continuation-in-part of Ser. No. 07/209,308 filed June 21, 1988 and of Ser. No. 07/280,250 filed Dec. 5, 1988, now abandoned.

BACKGROUND OF THE INVENTION

This invention relates to slings and more particularly to nursing bottle holders adapted to be suspended from the neck of a person holding an infant for feeding purpose.

Such an nursing bottle holder should be quickly adjustable to a variety of wearer sizes and body shapes as well as to a variety of infant positions. More significantly, the nursing bottle holder must not have any hard or sharp parts that could injure the infant, or any component that could come loose and be swallowed by him. It should be simply in construction and easy to clean or even sterilize. To that effect the nursing bottle holder should be submersible, and should withstand sterilizing temperatures. The prior art disclosed numerous attempts at meeting those requirements. Most structures of the prior art use sharp metal components such as booms, clamps, brackets, springs, and clips which could be injurious to the infant. Other prior structures include complex harnesses which are cumbersome to install, and offer only limited adjustability. Yet, others because of their size and multiplicity of building materials could not be easily and effectively cleaned or sterilized.

SUMMARY OF THE INVENTION

The principal and secondary objects of the invention is to provide a nursing bottle holder which can be quickly adapted to the particular body features of the wearer, can be quickly put on and taken off, is entirely made of soft material with no hard or sharp components that could injure the infant or come loose and be swallowed by him, and can be cleaned or sterilized by immersion into boiling water.

These and other objects are achieved by means of a nursing bottle holder which has a bendable but non-resilient neck-piece in the form of the open loop of a hook with a bellows-type expandable shank into which a simply clasp made of elastomeric material is rotatably plugged. The clasp itself may be an open loop or a closed ring. Either configuration can be opened or stretched to grasp a nursing bottle. It is the resiliency of the clasp itself in the absence of any metallic spring or clip which provides a stable and safe way to hold and orient the bottle to the most comfortable position for both the wearer and the infant.

DESCRIPTION OF THE PREFERRED EMBODIMENT OF THE INVENTION

Figure 1:
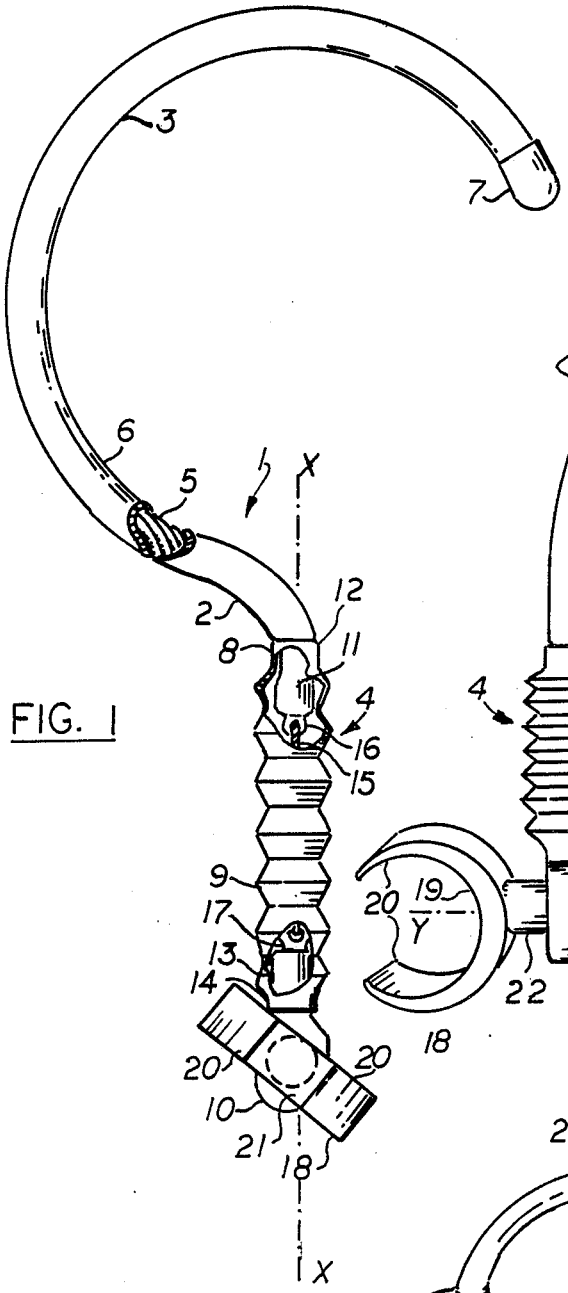
FIG. 1 is a front elevational view of a nursing bottle support with cutout sections exposing the internal configuration.

Referring now to the drawing, there is shown a nursing bottle support 1 which is designed to be worn by a person holding an infant, and to support a nursing bottle in a feeding position in order to free at least one of the person's hands.

The support comprises a hook 2 which defines an open loop 3 shaped and dimensioned to fit around the neck of the person, and a shank 4 sized to hang against the person's chest. The open loop section 3 is made from a flexible but non-resilient length of material. Specifically, the open loop is made from a length of multi-strand, heavy duty, electrical conductor 5 surrounded by a vinyl sleeve 6. Typically, a multi-strand insulated electrical conductor of gage 6 or lower may be used to form the open loop part of the hook 2. The open end of the hook is closed with a vinyl cap 7.

The shank 4 comprises three elements, the connecting end 8 of the open loop 3, an expandable segment 9 and the lower endpiece 10.

Figure 2:
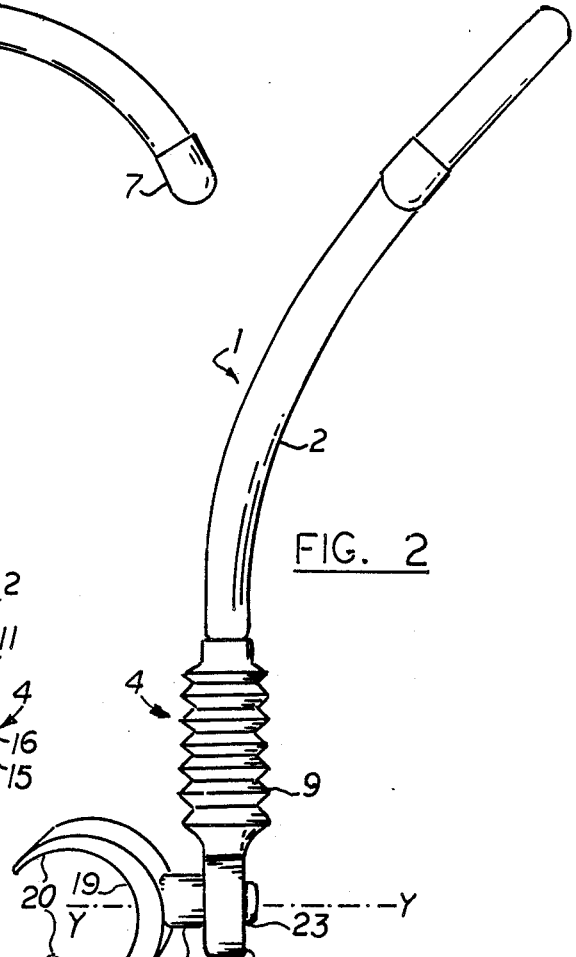
FIG. 2 is a side elevational view thereof with the shank shown in the collapsed position.

The expandable segment 9 comprises a tube of flexible material such as plastic, the wall of which has been molded to form a bellows. The bellows consist of a succession of accordion-type folds which are orthogonal to the axis X—X of the shank 4. The connecting end 8 of the loop is terminated by an enlarged head 11 which is captured behind the upper neck 12 of the expandable element 9. The end-piece 10 has a similar head 13 which is retained by the lower end-collar 14 of the expandable segment 9. The expandable element 9 is shown in its near fully extended position in FIG. 1, and in a collapsed, shortened position in FIG. 2. A string 15 connects two eyelets 16 and 17 respectively attached to the heads 11 and 13 through the center of the expandable element 9. In the event that either the endpiece 10 or the connecting end 8 of the open loop 3 are pulled out of the end-collars 12 and 14 of the expandable element 9, the string will prevent the elements from becoming separated completely and will facilitate reattachment of either end of the expandable element 9.

Figure 3:
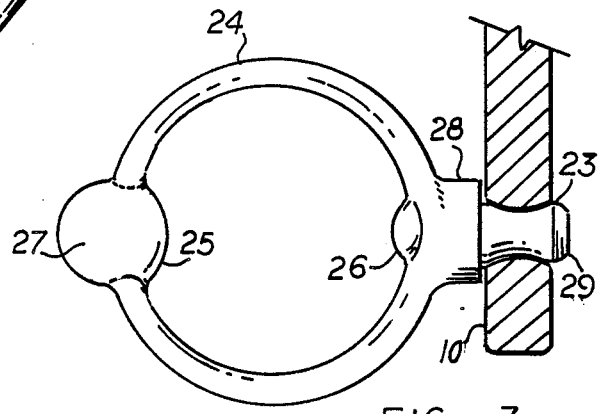
FIG. 3 is a side elevational view of an alternate embodiment of the bottle-holding element.

A feeding bottle holding clasp 18 is rotatably attached to the end-piece 10. This clasp is made from a soft elastomeric material, and defined an open loop 19 whose inner dimensions are slightly smaller than the outer diameter of the feeding bottle. The ends 20 of the open loop are tapered for added flexibility, so that they can be easily bent to increase the gap 21 through which the bottle can be inserted. A shaft 22 projecting radially from the outer periphery of the clasp 18 is captured by a bore 23 in the center of the end-piece 10. Thus, once the bottle is set in the clasp 18 it can be oriented in a variety of directions by either rotating the end-piece 10 about the axis X—X of the shank 4, and by rotating the clasp itself about the axis Y—Y of the bore 23. The height of the bottle can be varied by expanding or collapsing the expandable element 9, and the general position of the nursing bottle support can be easily adjusted by bending the hook 2 to obtain the most stable and the most comfortable position. FIG. 3 illustrates an alternate embodiment of the clasp comprising a ring 24 made of elastomeric material forming a closed loop with inner diameter corresponding to the outer diameter of the feeding bottle. Projections 25 and 26 on the inner surface of the ring are used to stabilize the bottle. The ring can be expanded by grabbing the flattened area 27 and pulling the loop over the end of the bottle. The mounting stub 28 which projects radially from the outer wall of the ring 24 has a pulley-shaped end 29 which match the contour of the bore 23 in the end-piece 10. Since the entire clasp assembly is made from elastomeric material the ring 24 can be pulled out from its mounting bore 23 for cleaning purpose and reinstalled by forcing the end 29 through the bore 23. The nursing bottle support 1 provides a practical and safe device for freeing at least one hand of a person trying to feed an infant being carried. There are no exposed metallic or sharp components that could injure the infant and the only piece that could come apart, the clasp 18 or 24 is too large to be swallowed by the infant and could safely be used as a teething ring.

While the preferred embodiment of an alternate configuration has been described, modification could be made and other embodiments could be devised without departing from the spirit of the invention and the scope of the appended claims.

What is claimed is:

1. A nursing bottle support for freeing the hands of a infant-carrying person, which comprises:

a bendable, non-resilient hook section formable into an open loop shaped and dimensioned to engage the neck of the person, and a generally straight shank sized to hang against the person's chest;

a resiliently adjustable clasp sized to fit around a nursing bottle; and a multi-directionally orientable means for attaching the clasp to the shank of the hook;

wherein the clasp comprises a generally ring-shaped element made of elastomeric material, and having an orientable means on its outer periphery for rotatably connecting said element to the shank of the hook; and wherein said bendable hook section is made from a length of electrical cable comprising, a core made from a multi-strand metallic conductor; and a insulating sleeve surrounding the conductor.

2. The nursing bottle support of claim 1, wherein said shank comprises an expandable tubular section.

3. A nursing bottle support for freeing the hands of a infant-carrying person, which comprises:

a bendable, non-resilient hook forming an open loop shaped and dimensioned to engage the neck of the person, and terminating into a generally straight shank sized to hang against the person's chest;

a resiliently adjustable clasp sized to fit around a nursing bottle; and a multi-directionally orientable means for attaching the clasp to the shank of the hook;

wherein the clasp comprises a generally ring-shaped element made of elastomeric material, and having orientable means on its outer periphery of said generally ring-shaped element for rotatably connecting said element to the shank of the hook;

wherein said bendable hook comprises a core made from a multi-strand metallic cable, and a cushioning sleeve surrounding the cable;

wherein said shank comprises an expandable tubular section comprising a tube of flexible material having its wall molded to define a series of circular accordion folds generally normal to the axis of the shank.

4. The nursing bottle support of claim 3, wherein the shank comprises an end-piece attached to said generally ring-shaped holding element.

5. The nursing bottle support of claim 4, wherein said orientable means for attaching comprises a prong extending radially from the outer surface of said ring-shaped element; and said end-piece having a bore shaped and dimensioned to rotatably engage said prong.

6. The nursing bottle support of claim 4, wherein said generally ring-shaped holding element comprises a closed loop of elastomeric material sized and dimensioned to resiliently fit around said nursing bottle.

7. The nursing bottle support of claim 3, wherein said hook is made from a length of vinyl-insulated electrical cable.

* * * * *